US007290394B2

(12) United States Patent
Lehtinen

(10) Patent No.: US 7,290,394 B2
(45) Date of Patent: Nov. 6, 2007

(54) FUEL INJECTOR FLEXIBLE FEED WITH MOVEABLE NOZZLE TIP

(75) Inventor: Jeffrey R. Lehtinen, Concord Township, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 265 days.

(21) Appl. No.: 10/718,184

(22) Filed: Nov. 20, 2003

(65) Prior Publication Data

US 2004/0129001 A1 Jul. 8, 2004

Related U.S. Application Data

(60) Provisional application No. 60/428,327, filed on Nov. 21, 2002.

(51) Int. Cl.
*F02C 7/20* (2006.01)

(52) U.S. Cl. ..... 60/800; 60/740

(58) Field of Classification Search ..... 60/800, 60/737, 740, 742

See application file for complete search history.

(56) References Cited

U.S. PATENT DOCUMENTS

| | | | | |
|---|---|---|---|---|
| 3,039,264 | A | | 6/1962 | Ernest |
| 3,048,977 | A | | 8/1962 | Geary, Jr. |
| 3,421,702 | A | | 1/1969 | O'Brien |
| 3,447,326 | A | | 6/1969 | Fuller |
| 3,759,446 | A | | 9/1973 | Bligh et al. |
| 4,454,711 | A | | 6/1984 | Ben-Porat |
| 4,693,074 | A | * | 9/1987 | Pidcock et al. ..... 60/740 |
| 4,735,044 | A | * | 4/1988 | Richey et al. ..... 60/742 |
| 4,835,971 | A | * | 6/1989 | Romey et al. ..... 60/740 |
| 4,850,196 | A | * | 7/1989 | Scalzo et al. ..... 60/740 |
| 5,435,884 | A | | 7/1995 | Simmons et al. |
| 5,570,580 | A | * | 11/1996 | Mains ..... 60/747 |
| 6,098,407 | A | * | 8/2000 | Korzendorfer et al. ..... 60/737 |
| 6,321,541 | B1 | | 11/2001 | Wrubel et al. |
| 6,523,350 | B1 | | 2/2003 | Mancini et al. |
| 6,547,163 | B1 | | 4/2003 | Mansour et al. |
| 2002/0189259 | A1 | | 12/2002 | Laing |

OTHER PUBLICATIONS

U.S. Appl. No. 60/428,327, filed Nov. 31, 2002, Jeffrey R. Lehtinen, Fuel Injector Flexible Feed With Moveable Nozzle Tip.

* cited by examiner

*Primary Examiner*—Ted Kim
(74) *Attorney, Agent, or Firm*—Christopher H. Hunter

(57) ABSTRACT

In a fuel injector assembly, for an internal combustion engine, a curved outer housing, fixed at one end, fully encloses a curved flexible fuel feed member, affixed to the housing inlet end and has a nozzle assembly operatively connected to an inner end, wherein the improvement comprises that the housing inlet includes at least one first shaped surface portion, and the nozzle assembly includes a movable nozzle spray-tip having another shaped surface portion that mates conformingly with and is in contact with the at least one shaped surface portion, resulting in relative motion therebetween upon operation of this engine, as a result of the thermal differential arising due to the differing temperatures of the housing and feed member.

20 Claims, 6 Drawing Sheets

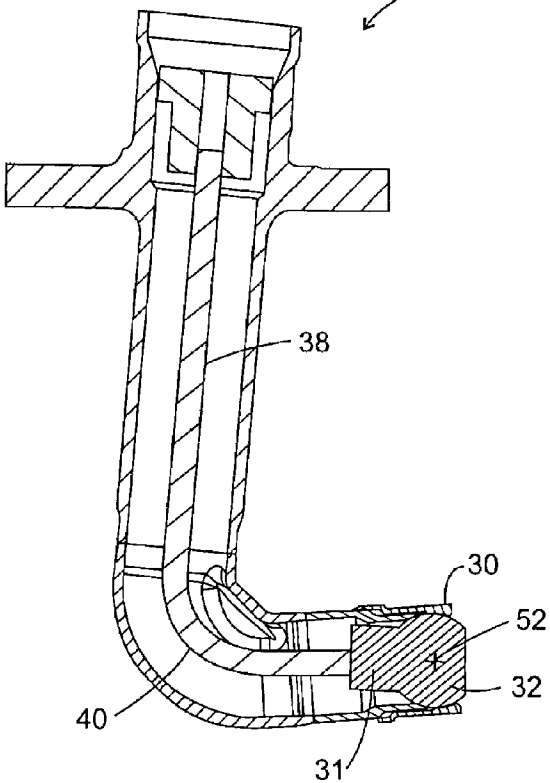
FIG. 2b - hot
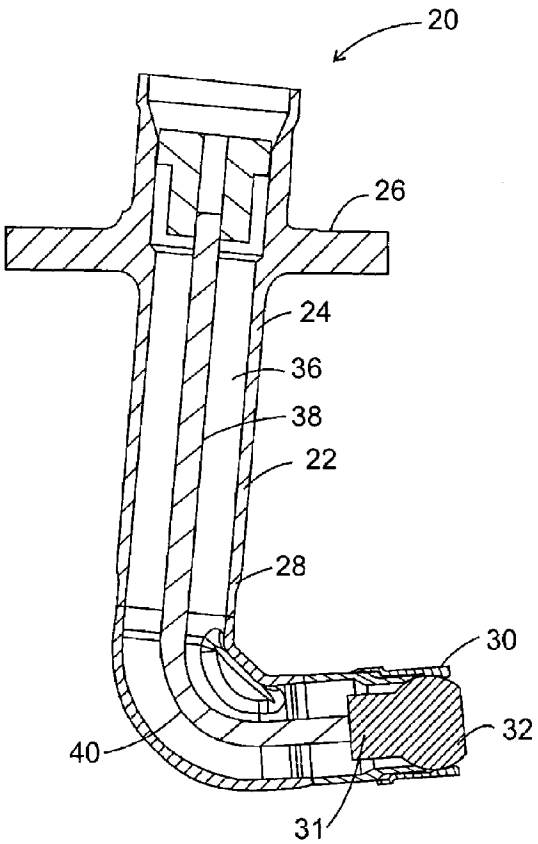
FIG. 2a - cold

FUEL INJECTOR FLEXIBLE FEED WITH MOVEABLE NOZZLE TIP

RELATED CASE

This application claims the priority of U.S. Provisional Application Ser. No. 60/428,327, filed Nov. 21, 2002, the disclosure of which is expressly incorporated herein by reference.

FIELD OF THE INVENTION

The present invention generally relates to fuel injectors, and more particularly, to fuel injectors having a flexible feed and movable nozzle spray-tip, useful for internal combustion engines, such as gas turbines.

BACKGROUND OF THE INVENTION

Fuel injector assemblies are useful for such applications such as gas turbine combustion engines for directing pressurized fuel from a manifold to one or more combustion chambers. Such assemblies also function to prepare the fuel for mixing with air prior to combustion. Each injector assembly typically has an inlet fitting connected to the manifold, a tubular extension or stem connected at one end to the fitting in a typically cantilevered fashion, and one or more spray nozzles connected to the other end of the stem or housing for directing the fuel into the combustion chamber. A single or multiple fuel feed (e.g., a cylindrical tubing or a MacroLaminate structure) circuits extend through the housing to supply fuel from the inlet fitting to the nozzle or nozzle assembly. Appropriate valves and/or flow dividers can be provided to direct and control the fuel flow through the nozzle. The fuel provided by the injector(s) is mixed with air and ignited so that the expanding gases of combustion can, for example, move rapidly across and rotate turbine blades in the gas turbine engine to provide power, for example, to an aircraft. Further discussion of a multi-layered feed strip and the technique for making same are set forth in U.S. Pat. No. 6,321,541 B1 to Wrubel et al. which is also owned by the assignee of this invention and which is also incorporated herein by reference.

In typical fuel injector assembly constructions, the fuel feed is fixedly attached at its inlet end and at its outlet end to the inlet fitting and nozzle, respectively, and generally includes a coiled or convoluted portion which is designed to absorb the mechanical stresses generated by the differences in thermal expansion of the internal nozzle component parts and the external nozzle component parts during engine combustion and shut-down. In addition, the fuel nozzle is fixedly and unyieldingly mounted to the inner end of the stem or housing. Due to the insulating air space between the housing and the fuel feed, the housing grows or expands to a much greater extent than the relatively cooler fuel feed which is enveloped by the former.

At elevated temperatures, the generally "L" or mirror-image J-shaped housing generally expands over the length of the long, vertical portion of the "L". However, since the fuel feed remains relatively cool, with reference to the surrounding housing, the fuel feed is pulled or stretched, by the housing, with the thermal differential therebetween being largely compensated by movement of the fuel feed over the short, horizontal leg portion of the "L".

The unsolved problem with the noted prior art construction is that if the nozzle tip is unyieldingly, rigidly attached to the housing, the occurring high stresses are maximized at a transition zone between the fuel feed inner end and the adjoining nozzle end, which can result in early low cycle fatigue failure of this assembly in the general area of the noted transition zone.

Attempted prior art solutions have been directed to self-aligning fuel nozzle assemblies of the type set forth in U.S. Pat. No. 4,454,711 to Ben-Porat, wherein the self-aligning fuel nozzle is described as reducing the development of local stresses between a turbine engine swirler member and the fuel nozzle so that wear between these parts is reduced. The Ben-Porat device is basically designed to maintain the proper alignment of the swirler and fuel nozzle for any displacement of the combustor liner relative to the combustor housing during the operation of an aircraft engine, as well as for improving engine fuel efficiency by compensating for relative movement between a liner and a combustor in six degrees of freedom. Thus, the Ben-Porat device attempts to not only solve a different problem but also the proposed structural solution, as best seen in FIG. 2 thereof, is much more mechanically complex as well as much more expensive in comparison with the present invention.

Another known construction utilizes a sliding, reciprocal, translational straight-line movement between the injector nozzle and the housing and/or shroud. However, this construction can be susceptible to excessive translational movement thereof, which in turn introduces another set of problems.

SUMMARY OF THE INVENTION

Accordingly, in order to overcome the deficiencies of prior art devices, the present invention provides a device or structure for permitting relative movement between a movable nozzle tip and the adjoining housing end, which has the net effect of safely transferring the noted high stresses to the large radius bend area of the generally L-shaped flexible fuel feed.

Specifically, in a fuel injector assembly, for dispensing fuel in the combustion chamber of a gas turbine engine, having a contoured outer housing, attached on one end to an engine casing, fully enveloping a contoured flexible fuel feed, fixedly attached at one end thereof to a housing inlet and having a nozzle assembly operatively connected therewith at another end, attached at a housing outlet end, the fuel feed being otherwise separated from the housing by a peripheral insulating space, the improvement comprises the housing outlet end having a first contoured surface portion, and the nozzle assembly including a movable nozzle spray-tip having a second contoured surface portion in complementary mating engagement with the housing first contoured surface portion, resulting in sliding relative motion therebetween upon the operation of the gas turbine engine, as a result of the thermal expansion differential arising due to the differing temperatures of housing the said fuel feed. The first and second contoured surface portions can be either interior or exterior surfaces and can be curved. Preferably, each of the contoured surface portions includes at least a portion of a spherical surface component.

In a variation thereof, the housing outlet end further includes a shroud, with the shroud including the first contoured surface portion.

In a further variation thereof, the contoured surface portions are curved and preferably include a spherical surface component.

In another variation thereof, the housing outlet end further includes an adaptor member, interposed between the housing outlet end and the shroud, the adaptor member including a further contoured surface portion, with the nozzle spray-tip exterior surface portion being in complementary mating engagement with both of the first and further contoured surface portions, the first and further contoured surface portions also being axially movable relative to each other, and each of the contoured surface portions including at least a portion of a spherical surface component.

In another embodiment of this invention, in a fuel injector assembly, for dispensing fuel in the combustion chamber of a gas turbine engine, having a shaped outer housing, attached at one end to an engine casing, fully enveloping a shaped flexible fuel feed line, affixed at one end thereof to a housing inlet and having a nozzle assembly operatively connected therewith at another end, affixed to a housing outlet end via a shroud and an intermediate adaptor member, the fuel feed line being otherwise separated from the housing by a surrounding insulating, closed, space, the improvement comprising the shroud and the adaptor member both including spaced first and second contoured surface portions, respectively, and the nozzle assembly including a movable, elastically deformable, nozzle spray-tip, having a third contoured surface portion mating with both the first and second contoured surface portions, resulting in pivotal relative motion therebetween upon the operation of the gas turbine engine, as a result of the thermal expansion differential arising from the differing temperatures of the housing and the fuel feed line. Preferably, each of the contoured surface portions are curved and include at least a portion of a spherical surface component, with the first and second spherical surface components also being axially movable relative to each other.

A differing embodiment of this invention pertains to an improved fuel injector assembly, for use in an internal combustion engine, including a curved outer housing, fixedly retained on one end at an engine casing, fully enclosing a curved flexible fuel feed member, the flexible feed member being affixed at an outer end to a housing inlet end and having a nozzle assembly operatively connected therewith at an inner end thereof, the nozzle assembly being yieldingly attached at a housing outlet end, with the fuel feed member being otherwise spaced from the housing via a peripheral insulating space, the improvement comprising the housing outlet end including at least one shaped surface portion, and the nozzle assembly including a movable nozzle spray-tip having another shaped surface portion complementarily matingly conforming with and being in contact with the at least one shaped surface portion, resulting in relative motion therebetween upon the operation of the internal combustion engine, as a result of the thermal expansion differential arising due to the differing temperatures of the housing and the fuel feed member. Preferably, each of the shaped surface portions is at least partially curved, with the at least one curved surface portion being interior surface portions and the other curved surface portion being an exterior surface portion.

In a variation thereof, each of the curved surface portions includes at least a portion of a spherical surface component with the at least one spherical surface component being interior surface components and the other spherical surface component being an exterior surface component. Preferably, the at least one curved surface portion includes a second curved surface portion, with the at least one and second curved surface portions also being axially movable relative to each other.

BRIEF DESCRIPTION OF THE DRAWINGS

FIGS. 2*a* and 2*b* are schematic showings of a simplified fuel injector assembly having a curvilinearly movable nozzle spray-tip, shown at ambient (cold) and operating (hot) conditions, respectively.

DETAILED DESCRIPTION OF THE PREFERRED EMBODIMENTS

Figure 1:
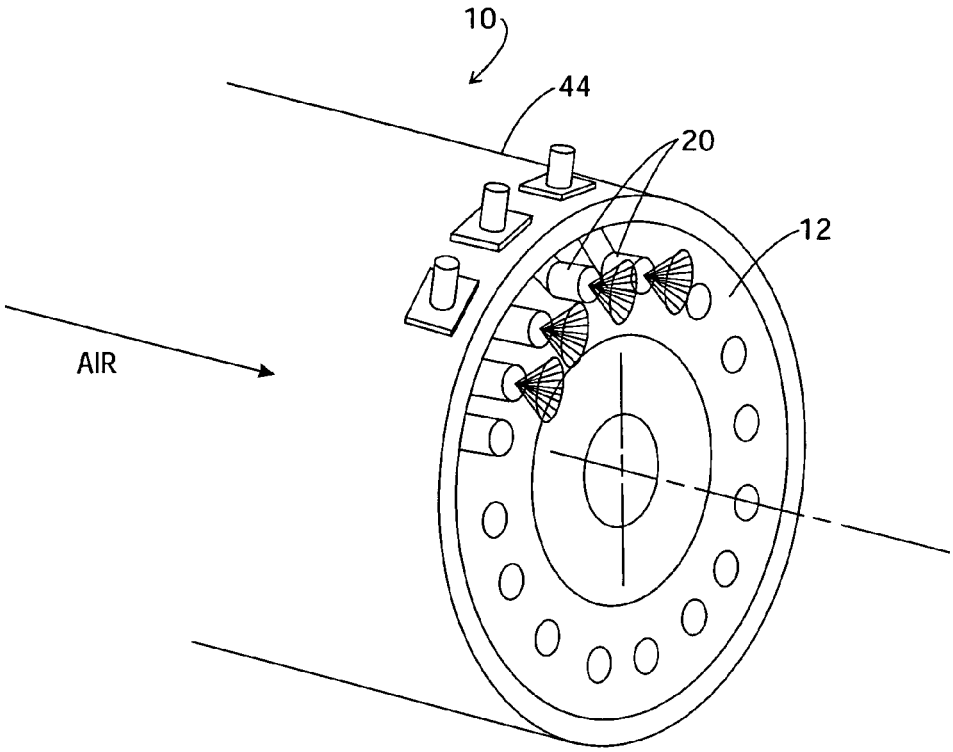
FIG. 1 is schematic and greatly simplified cross-sectional side view of a gas turbine engine combustion chamber, utilizing fuel injector assemblies constructed according to the principles of the present invention.

Referring now to the drawings, and initially to FIG. 1, a schematic and simplified portion of a gas turbine engine is indicated generally at 10. The upstream, front wall of a combustion chamber for the engine is shown at 12, and a plurality of fuel injector-assemblies, for example, as indicated generally at 20, constructed according to the present invention, are shown mounted within chamber 12. Combustion chamber 12 is a typical combustion chamber for aircraft applications, and will not be discussed further for the sake of brevity. The fuel injector assemblies 20 atomize and direct fuel into combustion chamber 12 for ignition. A compressor (not shown) is mounted upstream of the fuel injectors and provides pressurized air at elevated temperatures in combustion chamber 12 to facilitate the ignition. The air is typically provided at highly elevated temperatures, which can reach over 1000 degrees F. in aircraft applications.

While fuel injector assemblies 20 of the present invention are particularly useful in gas turbine engines for aircraft, these fuel injector assemblies are also deemed to be useful in other types of applications, such as in industrial power generating equipment and in marine propulsion applications.

Turning now particularly to FIGS. 2*a* and 2*b*, there are illustrated, in simplified schematic showings, a fuel injector assembly 20 comprised of a generally L-shaped housing 22, having an attachment flange 26 at an upper end portion 24 thereof, and a nozzle assembly including a nozzle tip adaptor 31 (FIG. 4 et al.), having a movable nozzle spray-tip 32, within a shroud 30, attached at a lower housing end portion 28 thereof. Located within housing 22, surrounded by a generally cylindrical, insulating space 36, is a flexible fuel feed 38, having a large radius bend 40, of any desired construction, such as cylindrically tubular or macrolaminated, for example. A typical hybrid atomizing nozzle is set forth in prior art U.S. Pat. No. 6,547,163 B1, which is also assigned to the assignee of the present invention and is incorporated herein by reference.

Figure 4:
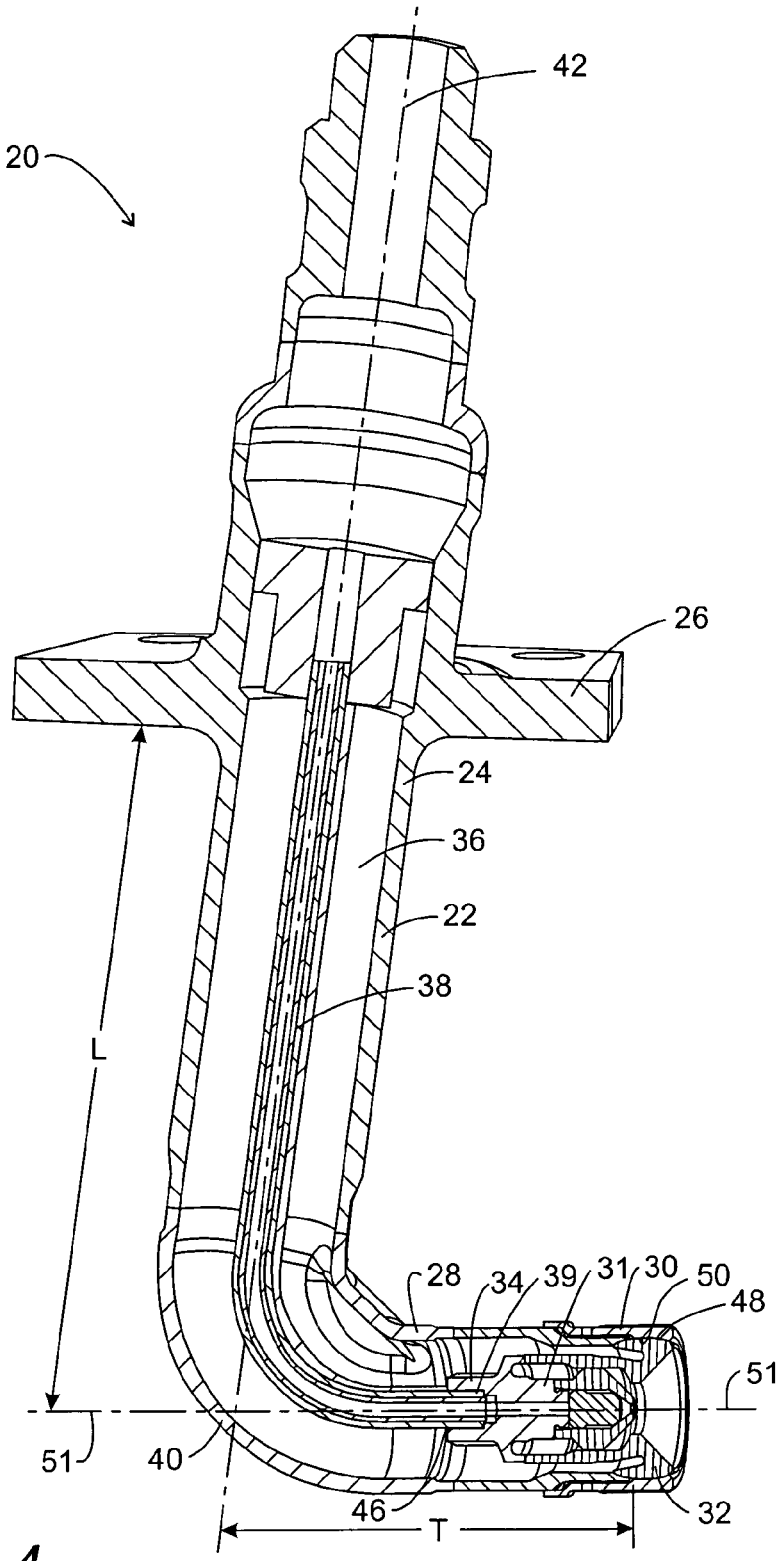
FIG. 4 is a schematic showing, in vertical cross section, of a fuel feed and housing portion of a fuel injector assembly incorporating a movable nozzle spray-tip of the type shown in FIG. 2.
Figure 5:
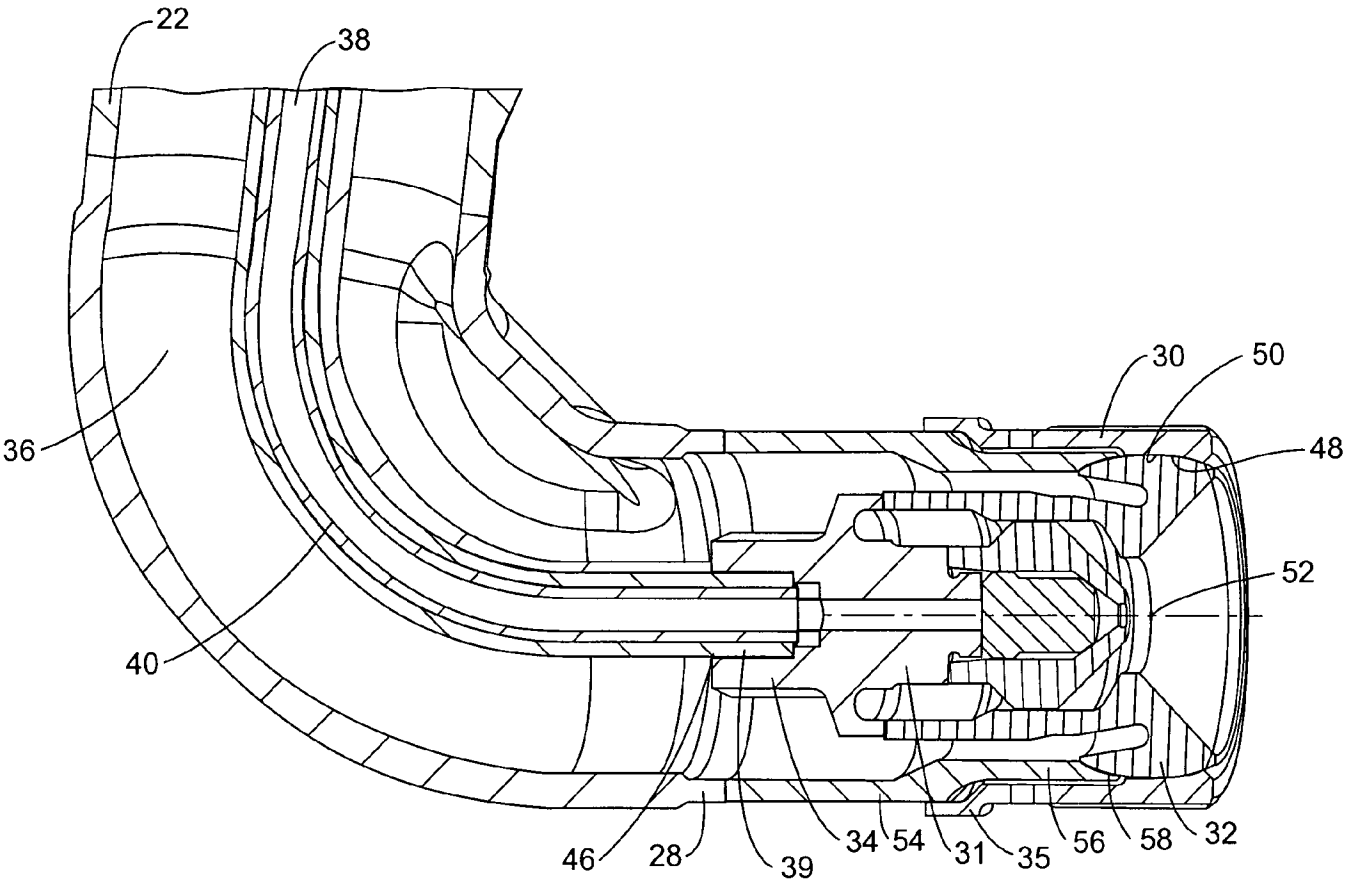
FIG. 5 is an enlarged schematic showing of the fuel feed large radius bend and the nozzle spray-tip of FIG. 4.

As better seen in FIGS. 4 and 5, fuel feed 38 includes a fuel inlet 42 and is affixed, such as by welding or brazing, to housing 22 at housing end portion 24. Flange 26 is removably attached to engine case 44 (FIG. 1). An inner end portion 39 of fuel feed 38 is affixed to an inner end 34 of nozzle tip adaptor 31 and forms a portion of a transition zone 46 from fuel feed 38 to adaptor 31 via inner ends 39 and 34 thereof, respectively.

Returning now to FIGS. 2*a*, 2*b* and 3, FIG. 2*a* illustrates assembly 20 at an ambient or cold condition, while FIG. 2*b* illustrates assembly 20 at an elevated or hot operating condition. In the hot operating condition, the outer surface of nozzle assembly 20 is exposed to temperatures in the general range of about 1000 to 1200 degrees F., while the temperature of internal fuel feed 38 reaches the general range of about 200 to 300 degrees F. As the result of known thermal expansion, housing 22 grows or expands, as best seen in FIG. 2*b*, relative to FIG. 2*a*.

Specifically, as best seen in FIG. 4, at an elevated temperature, housing 22 expands over the shown length "L". Since fuel feed 38 remains relatively cool, with reference to housing 22, fuel feed 38 is pulled or stretched by housing 22, with the thermal differential therebetween being largely compensated by movement of fuel feed 38 over shown length "T" in FIG. 4.

If nozzle spray-tip 32 is unyieldingly, rigidly attached to shroud portion 30 of housing 22, the resulting unacceptably high stresses are maximized at transition zone 46 between fuel feed inner end 39 and nozzle tip adaptor inner end 34, which can result in the early low cycle fatigue failure of this assembly in the general area of transition zone 46. However, if movable nozzle spray-tip 32 and shroud 30 are allowed to move relative to each other, the noted stresses are largely translated to and more readily absorbed or dissipated in large radius bend area 40 of flexible fuel feed 38.

As noted, in order to reduce the stresses in transition zone 46, relative motion must be permitted between nozzle spray-tip 32 and shroud 30. One such mechanism includes structures that permit nozzle spray-tip 32 to move via one or more of pivoting, sliding, rotating, reciprocating or combinations of such movements, for example. A schematic version of such a mechanism is illustrated in FIG. 3 wherein at least an exterior surface portion or "slice" of movable nozzle spray-tip 32 includes a contoured, curvilinear, or curved surface 48, such as a spherical surface component portion that is received in or cradled in a substantially-corresponding or mating interior contoured or curved surface portion 50 of shroud 30.

Figure 3:
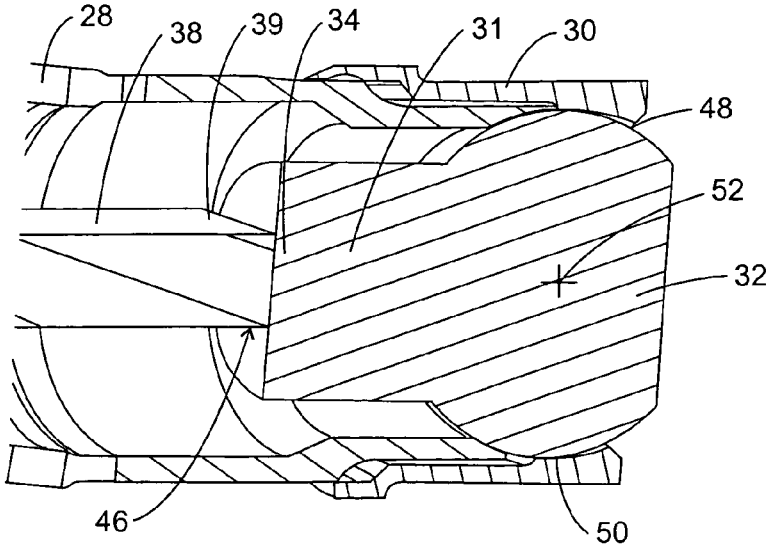
FIG. 3 is an enlarged, simplified showing of a construction of an adjoining fuel nozzle tip and nozzle shroud, of the type shown in FIG. 2, that permits swiveling movement therebetween.

As seen in each of FIGS. 2*b* and 5, nozzle spray-tip 32 can move or pivot, etc., around an axis 52, perpendicular to the plane of the paper on which FIG. 3 is illustrated. It should of course be understood that shroud 30 could move relative to nozzle spray-tip 32 and that such members can move relative to each other. The important concept here is that the mechanisms be structured so as to permit relative movement between shroud 30 and movable nozzle spray-tip 32.

Turning now specifically to FIG. 5, fixedly interposed, in this embodiment of the invention, between housing lower end 28 and an inner end 35 of shroud 30, is an adaptor member 54 whose outer end section 56, extending beyond shroud inner end 35, includes an interior contoured or curved surface portion 58. The shape or contour of portion 58 substantially corresponds to that of movable nozzle spray-tip exterior contoured or curved surface portion 48, with the former also being substantially similar in shape or contour to that of shroud interior curved surface portion 50. It should be clear from a perusal of FIG. 5 that nozzle exterior contoured surface portion 48 is in operative contact with each of stem or housing for directing the fuel into the combustion chamber. A single or multiple fuel feed (e.g., a cylindrical tubing cylindrical tubing or a MacroLaminate structure) circuits extend through the housing to supply fuel from the inlet fitting to the interior contoured surface portions 50 and 58. Preferably, shroud member 30 is adjustably secured, relative to adaptor member 54, so as to permit at least initial adjustment of the required clearance and/or fit between shroud 30 and adaptor member 54 so as to enable the desired relative movement for the retention of movable nozzle spray-tip 32 therebetween.

FIG. 5 also best illustrates that during engine operation, movable nozzle spray-tip curved surface portion 48 is pulled, as a result of the previously-noted thermal expansion characteristics, against adaptor member curved surface portion 58, causing movable and resilient nozzle spray-tip 32 to be rotated downwardly from horizontal plane 51 (FIG. 4). Calculations for one specific nozzle assembly configuration have shown that the resulting angle of rotation, inclination or deflection (not shown per se), about axis 52, to be about 1 or 2 degrees. Once such an angle of inclination has been determined, be it empirically or via actual experimentation, the angular relationships between shroud 30, adaptor member 54 and movable nozzle spray-tip 32 can be so controlled, adjusted or set that, when operating under "full power", movable nozzle spray-tip 32 is preferably substantially centered relative to or concentric, while being slightly off-center relative to or not fully concentric at other than "full-power" operating conditions. Thus, the relative movement and/or deflection between shroud 30 and movable nozzle spray-tip 32 reduces the stress, in nozzle assembly 20, in the area of transition zone 46, between nozzle 31 and shroud 30, thereby increasing the fatigue life of this assembly.

Figure 6:
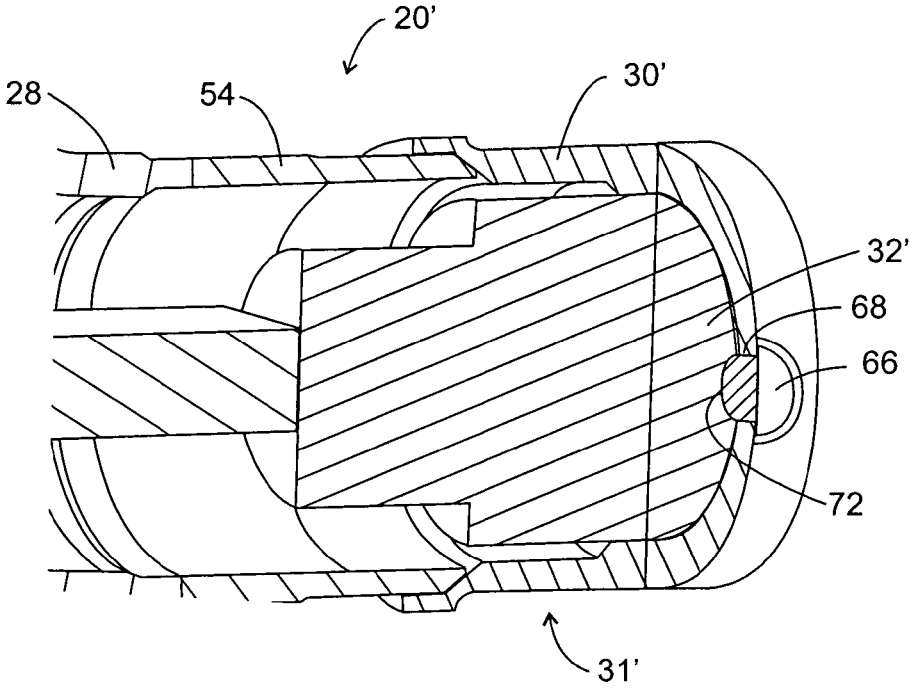
FIG. 6 is a schematic showing, similar to that of FIG. 3, utilizing another embodiment of a construction that permits relative movement between an adjoining fuel nozzle spray-tip and a nozzle shroud.
Figure 7:
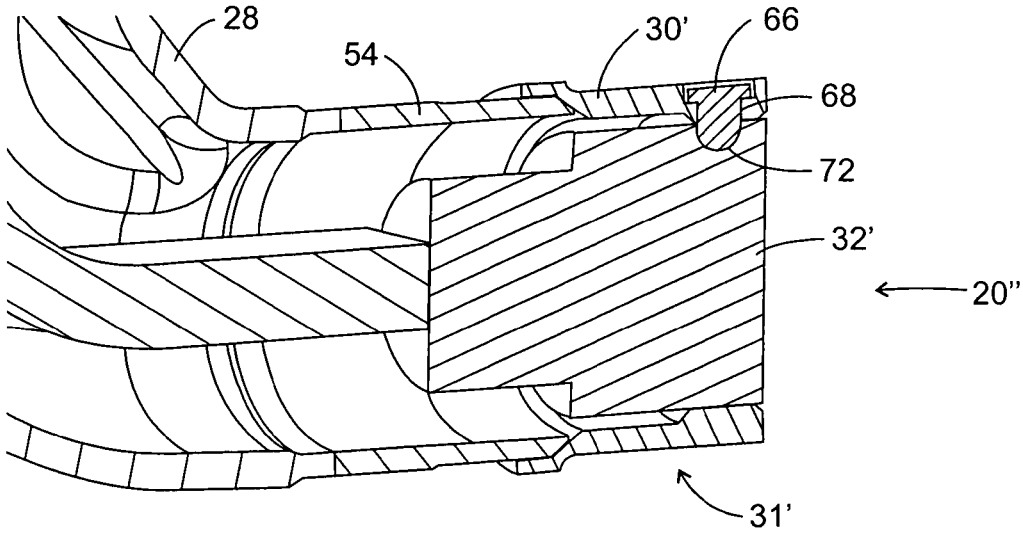
FIG. 7 is a schematic showing of another cylindrical nozzle spray-tip and pivot pin construction similar to that of FIG. 6.

Turning now to FIGS. 6 and 7, there are shown simplified fuel injector assemblies 20' and 20", respectively, which, except for shroud 30', nozzle tip adaptors 31' and movable nozzle spray-tip 32', are substantially similar to previously described fuel injector assembly 20 shown in FIGS. 2–5. The same reference numerals apply for like components, with the corresponding components bearing an affixed prime symbol.

Fuel injector assembly 20' differs from fuel injector assembly 20 mainly in that the former does not utilize a spherical nozzle tip construction. Rather, movable nozzle spray-tip 32' is preferably substantially cylindrical, or even frustoconical if desired, in shape and of a maximum body diameter slightly less than the smallest inside diameter of shroud 30' so that nozzle spray-tip 32' can have a tilting or pivoting-type movement relative to shroud 30'. This is accomplished in the FIG. 6 embodiment via two diametrically opposed pivot pin members 66 (only one shown) extending radially inwardly through a apertures 68, in shroud 30', into recesses 72 in nozzle spray-tip 32'. At least one pivot pin member 66, as illustrated in FIG. 7, is utilized, although the use of two diametrically opposed pin members 66 (FIG. 6) is preferred. While the inner end 72 of pin member 66 is shown as being hemispherical and located in a complementary surface in movable nozzle spray-tip 32', pin 72 can also be generally cylindrical or even frustoconical if so desired. It should be understood that movable nozzle spray-tip 32' can pivot or tilt slightly, via the at least one pivot pin member 66, so as to permit the relative movement and/or deflection between shroud 30' and movable nozzle spray-tip 32'.

In addition, a construction essentially the reverse of assembly 20" can also be utilized in that, instead of using one or more inwardly-directed pivot pin members 66, movable nozzle spray-tip 32' can be provided with at least one radially outwardly directed pivot member akin to member 66, the outer end of which is received within a complementary surface in the inner peripheral surface of shroud 30'. Again, the pin outer end can be hemispherical and/or cylindrical or the like. In such a construction, in order to permit assembly thereof, shroud 30' is preferably split into two semi-cylindrical shells.

Figure 7B:
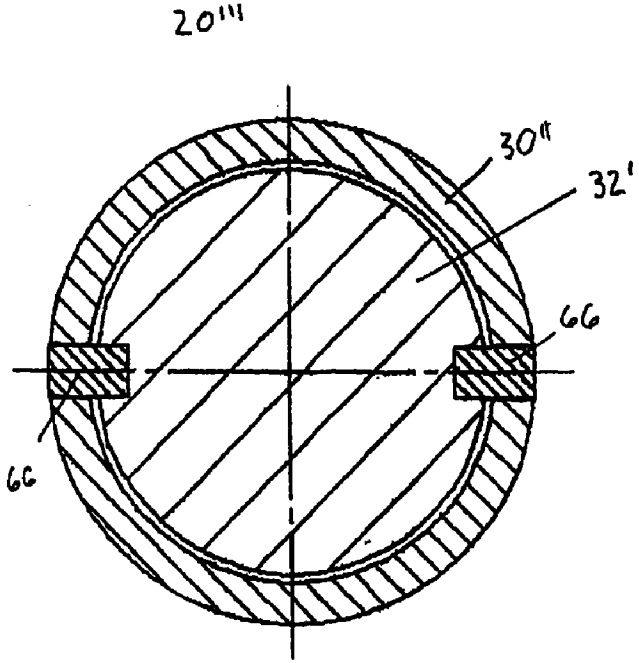
FIG. 7B is a view, similar to that of FIG. 7A, but showing the use of opposed pin members with the rotational interface of the pivot members on another of the components thereof.
Figure 7A:
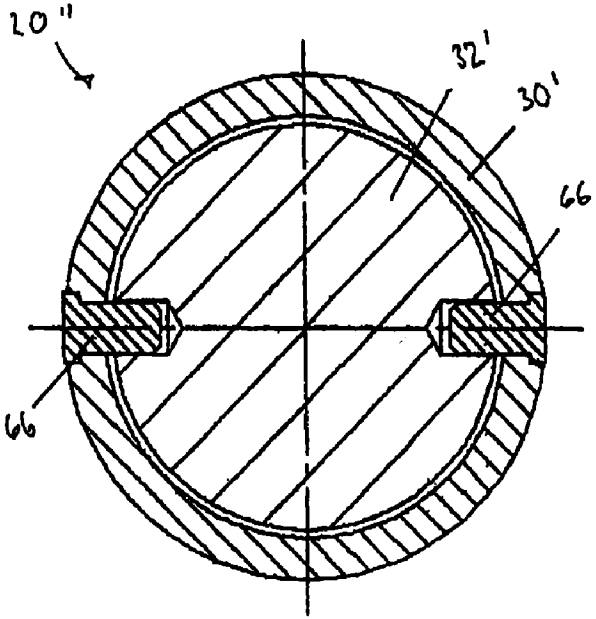
FIG. 7A is a transverse, schematic, cross-sectional view of the FIG. 7 nozzle construction, taken through the spray tip at the pivot pin line centers of rotation, showing opposed inwardly-directed pivot pin members on one component thereof.

Specifically, the construction of nozzle 20", shown in FIG. 7A, represents a transverse, schematic, cross sectional view of the FIG. 7 construction, taken through spray tip 32' at the center line of pivot pins 66. In the FIG. 7B construction of nozzle assembly 20'", even though opposed pin members 66 are similarly outwardly directed as in F*ig*. 7A, pin members 66 are fixedly received in spray tip 32', thereby shifting the rotational interface to shroud 30Δ, while, in Fig, 7A, the rotational interface remains with nozzle tip 32'. In the FIG. 7B construction, in order to facilitate the assembly of spray tip 32", shroud 30' of FIG. 7A may be split into two semi- cylindrical shell portions 30"(only one being shown) abutting at pin members 66, each shell portion having opposed cylindrical cutouts in order to accommodate pin members 66. Thus, the FIG. 7B construction is essentially the reverse of the FIG. 7A nozzle construction.

While there are shown and described several presently preferred embodiments of this invention, it is to be distinctly understood that the invention is not limited thereto, but may be otherwise variously embodied and practiced within the scope of the following claims.

What is claimed is:

1. In a fuel injector assembly, for dispensing fuel in the combustion chamber of a gas turbine engine, having a contoured outer housing, attached on one end to an engine casing, fully enveloping a contoured deformable fuel feed, fixedly attached at one end thereof to a housing inlet and having a nozzle tip adapter assembly operatively connected therewith at another end, attached at a housing outlet end, said fuel feed being otherwise separated from said housing by a peripheral insulating space, wherein the improvement comprises:

a. said housing outlet end having a first contoured surface portion; and b. said nozzle assembly including a movable nozzle spray-tip having a second contoured surface portion in complementary mating engagement with said housing first contoured surface portion, resulting in relative motion therebetween upon the operation of said gas turbine engine, as a result of the thermal expansion differential arising due to the differing temperatures of said housing and said fuel feed, wherein said first and second contoured surface portions are interior and exterior contoured surfaces, respectively, and wherein each of said contoured surface portions includes at least a portion of a spherical surface component.

2. The improved fuel injector assembly of claim 1, wherein said contoured surface portions are curved.

3. The improved fuel injector assembly of claim 1, wherein each of said contoured surface portions include a curved portion.

4. The improved fuel injector assembly of claim 1, wherein said housing outlet end further includes an adaptor member, interposed between said housing outlet end and said shroud, said adaptor member including a further contoured surface portion.

5. The improved fuel injector assembly of claim 4, wherein said nozzle spray-tip contoured surface portion is in complementary mating engagement with both of said first and further contoured surface portions.

6. The improved fuel injector assembly of claim 5, wherein said first and further contoured surface portions are also axially movable relative to each other.

7. The improved fuel injector assembly of claim 5, wherein each of said contoured surface portions includes at least a portion of a spherical surface component.

8. In a fuel injector assembly, for dispensing fuel in the combustion chamber of a gas turbine engine, having a contoured outer housing, attached on one end to an engine casing, fully enveloping a contoured deformable fuel feed, fixedly attached at one end thereof to a housing inlet and having a nozzle tip adapter assembly operatively connected therewith at another end, attached at a housing outlet end, said fuel feed being otherwise separated from said housing by a peripheral insulating space wherein the improvement comprises:

a. said housing outlet end having a first contoured surface portion; and b. said nozzle assembly including a movable nozzle spray-tip having a second contoured surface portion in complementary mating engagement with said housing first contoured surface portion, resulting in relative motion therebetween upon the operation of said gas turbine engine, as a result of the thermal expansion differential arising due to the differing temperatures of said housing and said fuel feed, wherein said first and second contoured surface portions are interior and exterior contoured surfaces. respectively, and wherein each of said contoured surface portions includes at least a portion of a spherical surface component.

9. The improved fuel injector assembly of claim 8, wherein said contoured surface portions are curved.

10. In a fuel injector assembly, for dispensing fuel in the combustion chamber of a gas turbine engine, having a contoured outer housing, attached on one end to an engine casing, fully enveloping a contoured deformable fuel feed, fixedly attached at one end thereof to a housing inlet and having a nozzle tip adapter assembly operatively connected therewith at another end, attached at a housing outlet end, said fuel feed being otherwise separated from said housing by a peripheral insulating space wherein the improvement comprises:

a. said housing outlet end having a first contoured surface portion: and b. said nozzle assembly including a movable nozzle spray-tip having a second contoured surface portion in complementary mating engagement with said housing first contoured surface portion, resulting in relative motion therebetween upon the operation of said gas turbine engine, as a result of the thermal expansion differential arising due to the differing temperatures of said housing and said fuel feed, wherein each of said contoured surface portions includes at least a partly spherical surface component, and wherein said housing outlet end further includes a shroud, with said shroud including said first contoured surface portion.

11. In a fuel injector assembly, for dispensing fuel in the combustion chamber of a gas turbine engine, having a shaped outer housing, attached at one end to an engine casing, fully enveloping a shaped metal fuel feed line, affixed at one end thereof to a housing inlet and having a nozzle assembly operatively connected therewith at another end, affixed to a housing outlet end via a shroud and an intermediate adaptor member, said fuel feed line being otherwise separated from said housing by a surrounding insulating, space, wherein the improvement comprises:

a. said shroud and said adaptor member both including spaced first and second contoured surface portions, respectively; and b. said nozzle assembly including a movable nozzle spray-tip, having a third contoured surface portion mating with both said first and second contoured surface portions, resulting in pivotal relative motion therebetween upon the operation of said gas turbine engine, as a result of the thermal expansion differential arising from the differing temperatures of said housing and said fuel feed line.

12. The improved fuel injector assembly of claim 11, wherein each of said contoured surface portions is curved.

13. The improved fuel injector assembly of claim 11, wherein each of said contoured surface portions includes at least a portion of a spherical surface component.

14. The improved fuel injector assembly of claim 13, wherein said first and second contoured spherical surface components are also axially movable relative to each other.

15. The improved fuel injector assembly as in claim 11, wherein the nozzle assembly includes a transition zone between the fuel feed line and the nozzle spray tip.

16. An improved fuel injector assembly, for use in an internal combustion engine, including a curved outer housing, fixedly retained on one end at an engine casing, fully enclosing a curved metal fuel feed member, said feed member being affixed at an outer end to a housing inlet end and having a nozzle assembly operatively connected therewith at an inner end thereof, said nozzle assembly being yieldingly attached at a housing outlet end, said fuel feed member being otherwise spaced from said housing via a peripheral insulating space, said improvement comprising:

a. said housing outlet end including at least one curved surface portion; and b. said nozzle assembly including a movable nozzle spray-tip having another curved surface portion complementarily matingly conforming with and being in contact with said at least one shaped surface portion, resulting in relative motion therebetween upon the operation of said engine, as a result of the thermal expansion differential arising due to the differing temperatures of said housing and said fuel feed member, and wherein at least one of said curved surface portions includes at least a portion of a spherical surface component.

17. The improved fuel injector assembly of claim 16, wherein said at least one curved surface portion is an interior surface portions and said another curved surface portion is an exterior surface portion.

18. The improved fuel injector assembly of claim 16, wherein said at least one curved surface portion is an exterior surface portion and said another curved surface portion is an interior surface portion.

19. The improved fuel injector assembly of claim 18, wherein at least one of said spherical surface components is one of an interior and exterior surface component and said another shaped surface portion is one of an exterior and interior surface component, respectively.

20. The improved fuel injector assembly of claim 16, wherein said at least one shaped portion includes a second curved surface portion, with said at least one and second shaped portions also being axially movable relative to each other.

* * * * *